US009822590B2

(12) United States Patent
Deville et al.

(10) Patent No.: US 9,822,590 B2
(45) Date of Patent: Nov. 21, 2017

(54) APPARATUS AND METHODS FOR TESTING INDUCTIVELY COUPLED DOWNHOLE SYSTEMS

(71) Applicant: Schlumberger Technology Corporation, Sugar Land, TX (US)

(72) Inventors: Benoit Deville, Paris (FR); Yann Dufour, Châtillon (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 247 days.

(21) Appl. No.: 14/376,846

(22) PCT Filed: Feb. 8, 2013

(86) PCT No.: PCT/US2013/025240

§ 371 (c)(1),
(2) Date: Aug. 5, 2014

(87) PCT Pub. No.: WO2013/119884

PCT Pub. Date: Aug. 15, 2013

(65) Prior Publication Data

US 2014/0374085 A1 Dec. 25, 2014

(30) Foreign Application Priority Data

Feb. 10, 2012 (EP) ..... 12290049

(51) Int. Cl.

| | |
|---|---|
| ***E21B 17/02*** | (2006.01) |
| ***E21B 47/12*** | (2012.01) |
| ***H01F 38/14*** | (2006.01) |

(52) U.S. Cl.
CPC ..... *E21B 17/028* (2013.01); *E21B 47/122* (2013.01); *H01F 38/14* (2013.01)

(58) Field of Classification Search
CPC .... E21B 47/122; E21B 47/011; E21B 17/028; E21B 17/003; E21B 41/0035; G01V 3/28; H01F 38/14
See application file for complete search history.

(56) References Cited

U.S. PATENT DOCUMENTS 4,901,069 A * 2/1990 Veneruso ..... E21B 17/003 166/66
5,563,512 A * 10/1996 Mumby ..... G01V 3/30 175/50

(Continued)

FOREIGN PATENT DOCUMENTS

| | | |
|---|---|---|
| GB | 2395503 | 5/2004 |
| GB | 2407334 | 4/2005 |

(Continued)

OTHER PUBLICATIONS

Extended European Search Report issued in related EP Application No. 12290049.1 dated Jul. 13, 2012 (7 pages).

(Continued)

*Primary Examiner* — Kipp Wallace

(57) ABSTRACT

Apparatus and methods for testing inductively coupled downhole systems are described. An example inductive coupler assembly for use in a wellbore includes an inductive coupler fixed to a completion in the wellbore, a drill pipe, a portion of which is to be located adjacent to the inductive coupler, and a sleeve surrounding the portion of the drill pipe to reduce a reluctance of a magnetic circuit including the inductive coupler.

18 Claims, 7 Drawing Sheets

(56) References Cited

U.S. PATENT DOCUMENTS

| | | | | |
|---|---|---|---|---|
| 6,768,700 | B2 * | 7/2004 | Veneruso | E21B 47/12 340/853.2 |
| 7,436,183 | B2 * | 10/2008 | Clark | E21B 47/122 324/338 |
| 7,525,315 | B2 * | 4/2009 | Fredette | E21B 47/01 324/339 |
| 8,497,673 | B2 * | 7/2013 | Wang | G01V 3/28 324/166 |
| 9,217,327 | B2 * | 12/2015 | Tarayre | E21B 47/122 |
| 2001/0035288 | A1 * | 11/2001 | Brockman | E21B 17/003 166/65.1 |
| 2002/0171560 | A1 * | 11/2002 | Ciglenec | E21B 7/061 340/853.1 |
| 2004/0060708 | A1 * | 4/2004 | Clark | E21B 47/01 166/380 |
| 2009/0085701 | A1 | 4/2009 | Veneruso et al. | |
| 2011/0011580 | A1 * | 1/2011 | Clark | E21B 33/124 166/244.1 |

FOREIGN PATENT DOCUMENTS

| | | | |
|---|---|---|---|
| RU | 2339791 | C2 | 11/2008 |
| WO | 2013142381 | | 9/2013 |

OTHER PUBLICATIONS

Official Action issued in related KZ Application No. 2014/1693.1 dated Feb. 4, 2016, and English translation by agent (5 pages).
International Search Report and Written Opinion issued in related International Application No. PCT/US2013/025240 dated Apr. 4, 2013 (11 pages).

* cited by examiner

MAGNETIC CIRCUIT

APPARATUS AND METHODS FOR TESTING INDUCTIVELY COUPLED DOWNHOLE SYSTEMS

FIELD OF THE DISCLOSURE

This disclosure relates generally to downhole environments and, more particularly, to apparatus and methods for testing inductively coupled downhole systems.

BACKGROUND OF THE DISCLOSURE

A completion system is installed in a well to produce hydrocarbon fluids, commonly referred to as oil and gas, from reservoirs adjacent the well or to inject fluids into the well. In many cases, the completion system includes electrical devices that have to be powered and which communicate with an earth surface or downhole controller. Such electrical devices may be associated with a reservoir monitoring and control (RMC) system and/or any other systems associated with a downhole environment (e.g., in a wellbore or borehole penetrating one or more subterranean formations).

Power and/or communication signals (e.g., electrical signals) may be provided to an RMC system and/or other downhole systems via a network of electrical cables or lines and inductive couplers. The inductive couplers may be used to magnetically convey electrical signals between different sections of electrical cable or lines. In this manner, the inductive couplers eliminate the need for conductive electrical connection between certain sections of the network. For example, a mother or main borehole may have a number of lateral branches or lateral boreholes, each of which includes electrical cables or lines that are coupled via an inductive coupler pair (i.e., mating male and female couplers) to a cable and/or lines (e.g., a bus) extending along the main borehole.

DETAILED DESCRIPTION

Figure 1:
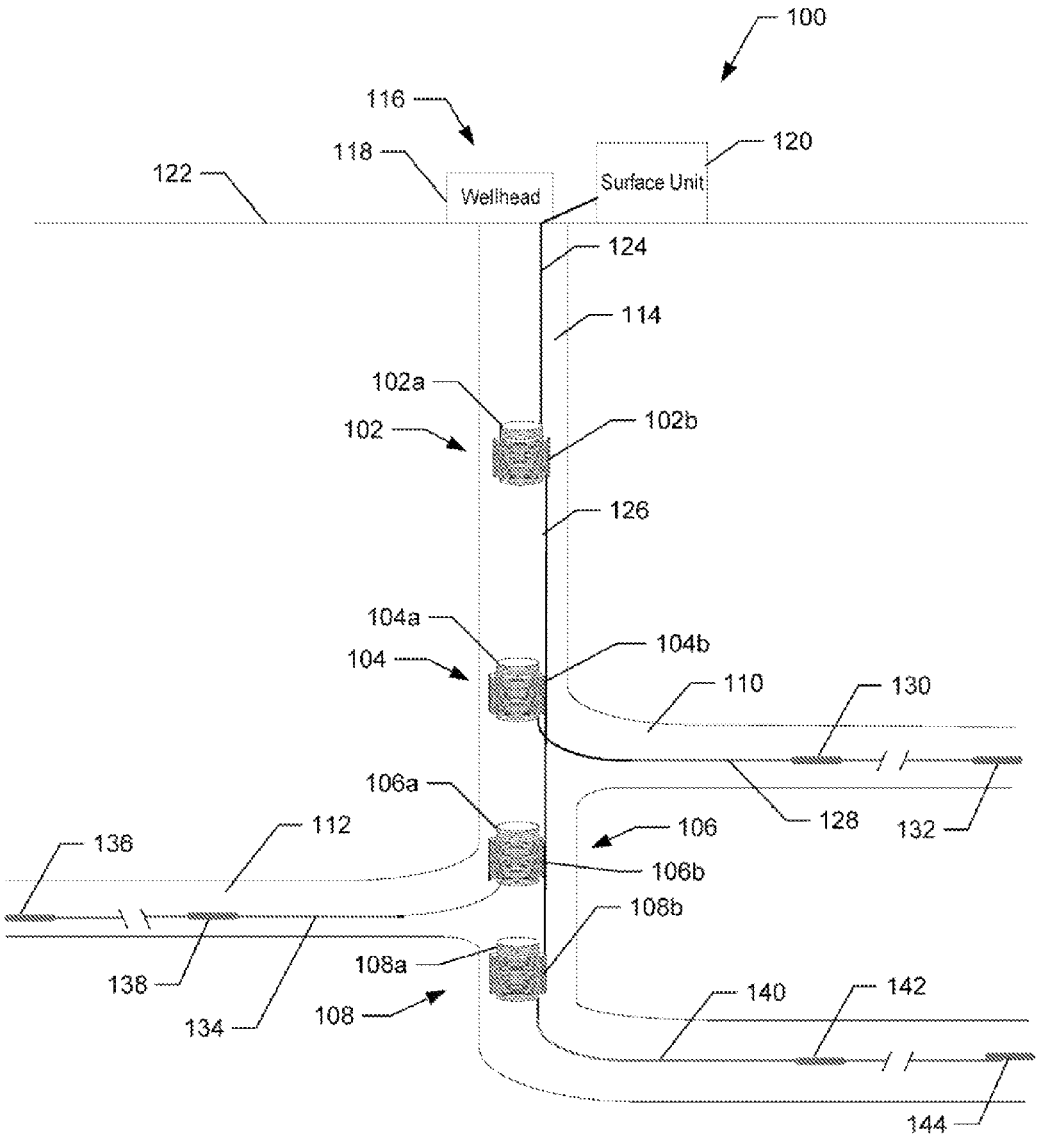
FIG.1 (Prior Art)
FIG. 1 illustrates a known completion architecture that uses inductive couplers to provide electrical signals to lateral boreholes.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

In accordance with the examples described herein, inductive couplers may be used to provide electrical signals within a downhole environment. For example, inductive couplers may be used to distribute power and/or communication signals between a main wellbore or borehole and one or more lateral boreholes. In other words, the inductive couplers may be used to magnetically couple electrical signals between an electrical cable or lines (e.g., a bus or busses) extending along a main borehole and the one or more lateral boreholes, thereby eliminating the need to make conductive electrical connections between the electrical lines in the main borehole and the electrical lines extending along the lateral boreholes.

However, in practice, a well site may be developed in phases such that a mother or main borehole may be completed first and one or more additional lateral boreholes may be completed during different later phases. Similarly, the electrical systems associated with the well site may be deployed in one or more phases associated with the development of the various boreholes making up the well site. As a result, at any given time during the development of the well site, one or more of the electrical systems may be only partially completed, which can complicate the testing and/or use of these systems. In some cases, it may not be safe or practical to operate such partially completed systems.

In the case of RMC systems and/or other downhole systems, one or more inductive couplers may be connected in parallel along a main cable or lines (e.g., one or more signal busses) extending along a main borehole. These inductive couplers may be female type couplers that are fixed to a completion lining the main borehole. Ultimately, each of the female inductive couplers of the completion are to be mated with male inductive couplers, each of which couples electrical signals from its corresponding female coupler and, thus, the main lines or buss(es) to electrical devices located along a respective lateral borehole. However, during development of the well site, one or more of the female couplers may not be mated with corresponding male couplers. For example, lateral boreholes corresponding to female inductive couplers in the main borehole may not yet be drilled or completed and, thus, the male inductive couplers for these lateral boreholes are not installed (i.e., mated to corresponding female inductive couplers).

As described in greater detail below, female inductive couplers that have not been mated with a male inductive coupler exhibit a relatively low inductance or high reluctance and, thus, subject the main electrical cables or lines (e.g., the bus or busses) to a high, reactive electrical load. The electrical load (e.g., current consumption) associated with the unmated female coupler(s) may be sufficiently high to inhibit or prevent the operation and/or testing of the various electrical devices that may be receiving electrical signals (e.g., power and/or communications) via the main electrical cable or lines. For example, it may be necessary or desirable to operate and/or test the operation an RMC system in a downhole environment in which a main borehole has been completed but where one or more lateral boreholes have not yet been completed. With many known systems and methods, such operation and/or testing would be very difficult or impossible due to the excessive power consumption of the unmated female inductive couplers.

The example apparatus and methods described herein may be used to substantially reduce the reluctance (increase the inductance) of an inductive coupler (e.g., a female inductive coupler fixed to a completion) that has not been mated with its corresponding inductive coupler (e.g., a male inductive coupler). In this manner, the example apparatus and methods described herein may be used to enable operation and/or testing of one or more electrical devices of an RMC system or other downhole system in which one or more female inductive couplers provide electrical signals to the electrical devices of the downhole system while one or more other female inductive couplers connected in parallel along the main cable, lines or buss(es) remain unmated with a corresponding male inductive coupler.

More specifically, in one example described herein, an inductive coupler assembly for use in a wellbore includes a female inductive coupler fixed to a completion in the wellbore, a drill pipe, a portion of which is to be located adjacent (e.g., within) to the inductive coupler. In addition, a sleeve may surround the portion of the drill pipe to reduce a reluctance of a magnetic circuit including the inductive coupler.

The sleeve comprises a magnetic material (e.g., carbon steel) having, for example, a permeability greater than one. To reduce eddy currents and, thus, power consumption associated with the use of the sleeve, the example sleeve may include openings or slots extending along the length of the sleeve. Such openings or slots increase the path lengths of any circulating currents and, thus, the effective resistance of the sleeve. Alternatively, the sleeve may be a multi-layer structure formed using alternating layers of a metal material (e.g., a ferrous material) and an electrically insulating material. In some examples, these layers of material may be formed by co-wrapping these materials about a cylindrical form.

In use, the example sleeve may surround a portion of a drill pipe and the sleeve and the portion of drill pipe may be lowered into a wellbore to be aligned with or disposed adjacent (e.g., within) an unmated female inductive coupler, thereby substantially increasing the inductance, decreasing the reluctance and decreasing the reactive electrical load imparted by the female coupler on the main cable or bus. Additional sleeves may be employed such that a sleeve is disposed adjacent to each unmated female inductive coupler. Once the drill pipe and/or sleeves have been positioned adjacent to or aligned with the unmated female inductive couplers, testing of a downhole system (e.g., an RMC system) can be performed. For example, one or more electrical tests of one or more devices associated with the downhole system may be performed.

Now turning in detail to the figures, FIG. 1 illustrates a known completion architecture 100 that uses inductive coupler pairs 102, 104, 106 and 108 to provide electrical signals to lateral boreholes 110 and 112 extending from a main wellbore or borehole 114. The known architecture 100 may be implemented at a well site 116 having a wellhead 118 and a surface unit 120 located at the Earth's surface 122.

The surface unit 120 may provide power and/or communication signals (e.g., electrical signals) via an electrical cable or line(s) 124 that is coupled to a main bus 126 via the coupler pair 102. The main bus 126 extends along the main borehole 114 and female inductive coupler portions 104*b*, 106*b* and 108*b* corresponding to the respective inductive coupler pairs 104, 106 and 108 are electrically connected in parallel to the main bus 126. A male coupler portion 104*a* of the coupler pair 104 is electrically connected to a lateral bus 128 extending along the lateral borehole 110. One or more monitoring and/or control nodes 130 and 132 may be electrically connected to the lateral bus 128 and, thus, may receive power and/or engage in communications with (e.g., send and/or receive data, commands, etc. to) the surface unit 120 via the lateral bus 128. Similarly, a male coupler portion 106*a* of the coupler pair 106 is electrically connected to a lateral bus 134 extending along the lateral borehole 112. Monitoring and/or control nodes 136 and 138 may be electrically connected to the lateral bus 134. Additionally, a male inductive coupler 108*a* of the inductive coupler pair 108 is electrically connected to a bus 140, which is electrically connected to monitoring and/or control nodes 142 and 144 located within the main borehole 114.

In the architecture 100 shown in FIG. 1, the busses 126, 128, 134 and 140, the monitoring and/or control nodes 130, 132, 136, 138, 142 and 144, the inductive coupler pairs 102, 104, 106, and 108, and the surface unit 120 may be part of an RMC system. In the known system shown in FIG. 1, the well site is fully completed and, thus, each of the female inductive couplers 104*b*, 106*b* and 108*b* is mated with a respective one of the male couplers 104*a*, 106*a* and 108*a*. In operation, each of the coupler pairs 104 and 106 and the respective control and/or monitoring nodes 130, 132 and 136, 138 to which the pairs 104 and 106 are coupled consumes about 25 Watts (VA).

Figure 2:
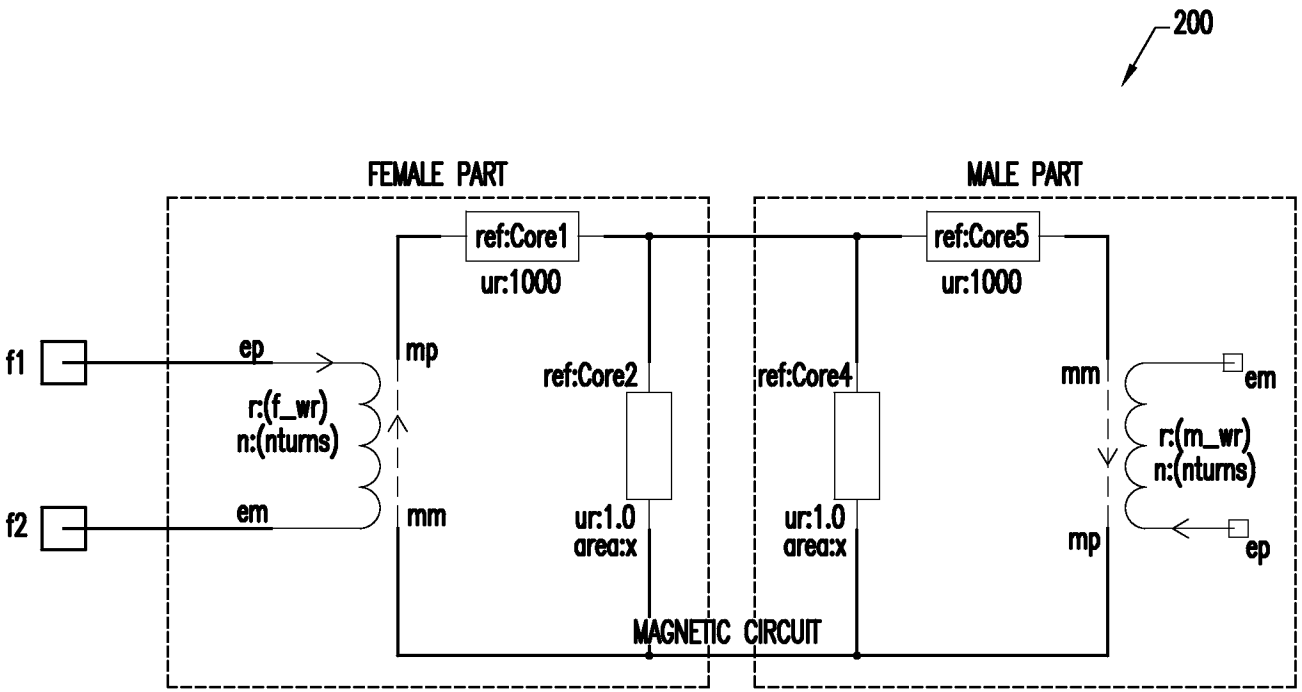
FIG. 2 is a schematic representation of an electrical equivalent circuit for a female inductive coupler coupled to a male inductive coupler.

FIG. 2 is a schematic representation of an electrical equivalent circuit 200 for a female inductive coupler coupled to a male inductive coupler. In general, the reluctance of a magnetic circuit can be determined via Equation 1 below.

$$R = \frac{1}{\mu} * \frac{1}{s} \qquad \text{Equation 1}$$

In Equation 1, l is the length of the magnetic circuit, s is the cross-sectional area of the magnetic circuit and μ is the permeability of the magnetic circuit. The inductance of the magnetic circuit can be calculated using the reluctance R from Equation 1 and Equation 2 below.

$$L = \frac{N^2}{R} \qquad \text{Equation 2}$$

In Equation 2, the variable N is the number of turns of the coupler winding.

Applying Equations 1 and 2 to the equivalent circuit shown in FIG. 2 yields Equations 3 and 4 below.

$$R = 2 * R_{Core1} = \frac{2}{1000} * \frac{l}{s} = \frac{\alpha}{500} \quad \text{Equation 3}$$

where $$\frac{l}{s} = \alpha$$

$$L_{female} = 500 * \beta \quad \text{Equation 4}$$

where $$\beta = \frac{N^2}{\alpha}$$

Wherein the 1000 value is for exemplary purposes. Thus, the reluctance of a coupled or mated female inductive coupler is relatively low and the inductance is relatively high.

Figure 3:
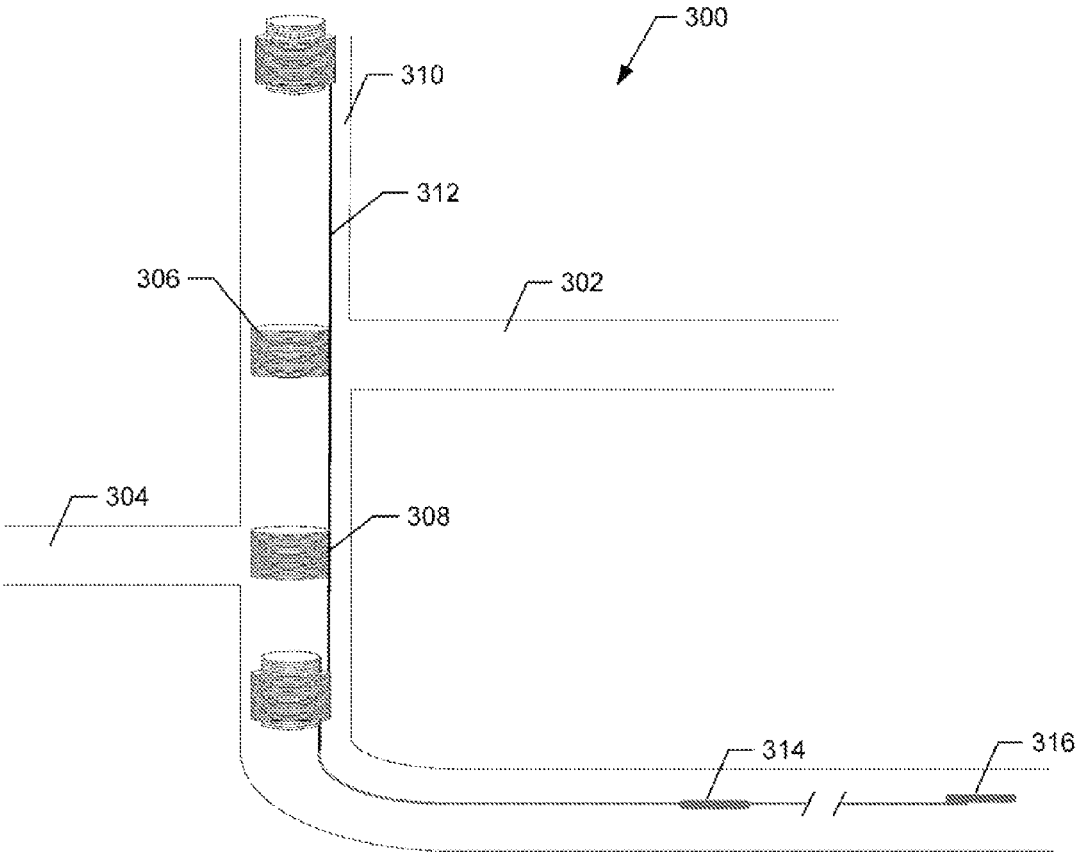
FIG. 3 illustrates an example completion architecture in which two lateral boreholes are incomplete and do not include male inductive couplers for corresponding female inductive couplers located along a main borehole.

FIG. 3 illustrates an example completion architecture 300 in which two lateral boreholes 302 and 304 are incomplete and do not include male inductive couplers for corresponding female inductive couplers 306 and 308 that are located along a main borehole 310 and which are electrically connected in parallel to a bus 312. As described in more detail below, the unmated female inductive couplers 306 and 308 impart a substantial reactive load on the bus 312 and may inhibit or prevent testing of, for example, control and/or monitoring nodes 314 and 316 due to power limitations of a surface unit (not shown) that may be supplying power to the nodes 314 and 316. Each of the unmated female inductive coupler 306 and 308 may consume about 90 Watts (VA) for a total of about 180 Watts. The additional power consumed by the nodes 314 and 316 may bring the total power consumption to over 200 Watts, which may be more than the capacity of the bus 312 and/or a surface unit supplying power to the bus 312.

Figure 4:
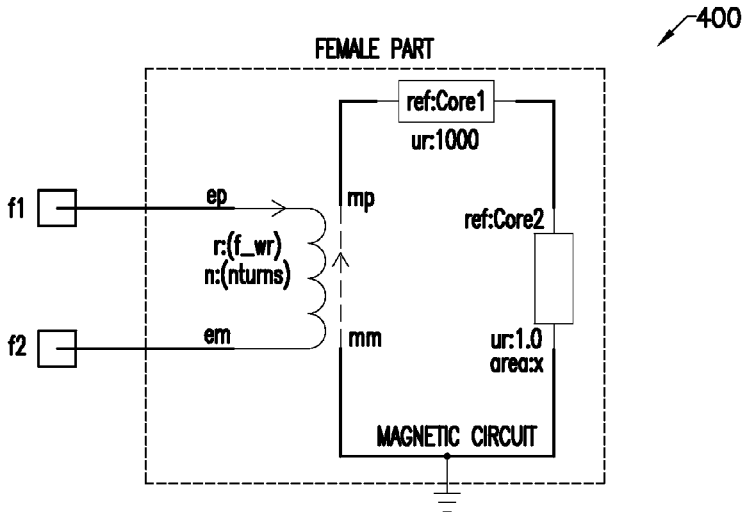
FIG. 4 is a schematic representation of an equivalent circuit for a female inductive coupler that is not coupled to a male inductive coupler.

FIG. 4 is a schematic representation of an equivalent circuit 400 for a typical female inductive coupler that is not coupled to a male inductive coupler. Using Equations 1 and 2 above, the reluctance and inductance of the equivalent circuit 400 of FIG. 4 may be represented using Equations 5 and 6 below.

$$R = R_{Core1} + R_{Core2} = \frac{1}{1000} * \frac{l}{s} + \frac{l'}{s'} \approx \frac{l'}{s'} \quad \text{Equation 5}$$

$$L = 25 * \beta \quad \text{Equation 6}$$

Thus, the reluctance of the unmated female inductive coupler is substantially higher and its inductance is substantially lower (i.e., twenty times lower) than that provided by the coupled or mated inductive coupler pair analyzed above in connection with FIG. 2 and Equations 3 and 4. The relatively low inductance imparted by an unmated female inductive coupler (e.g., the couplers 306 and/or 308 of FIG. 3) on a bus (e.g., the bus 312 of FIG. 3) may prevent proper operation and/or testing of monitoring and/or control nodes (e.g., the nodes 314 and 316) coupled to the bus.

Figure 5:
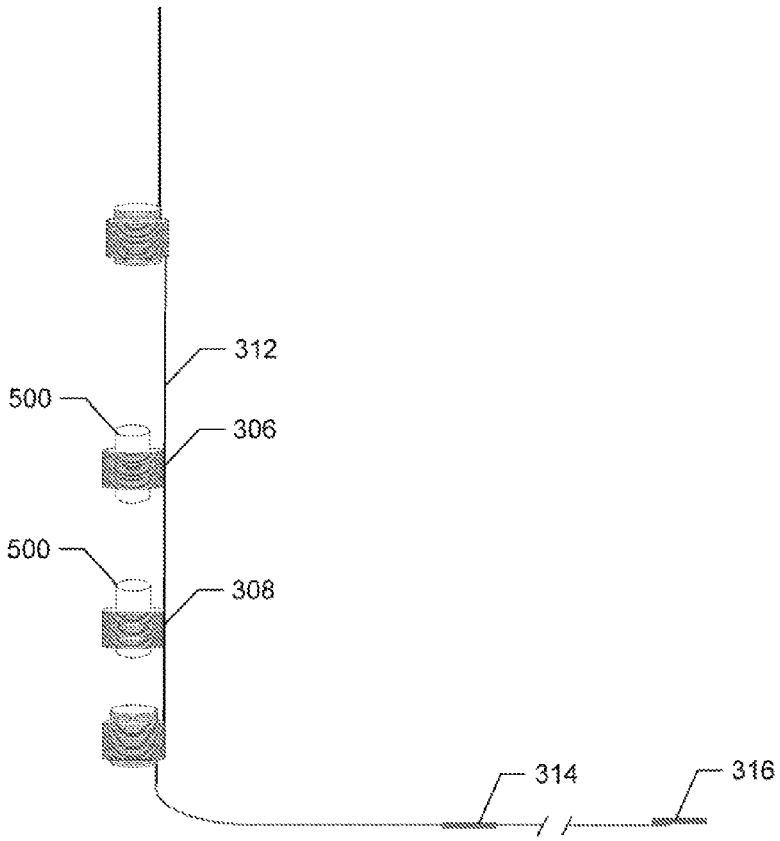
FIG. 5 illustrates the example completion architecture of FIG. 3 in which drill pipe is disposed in at least the female couplers associated with the incomplete lateral boreholes to facilitate electrical testing.

FIG. 5 illustrates the example completion architecture of FIG. 3 in which drill pipe 500 is disposed in at least the female inductive couplers 306 and 318 associated with the incomplete lateral boreholes to facilitate electrical testing. As demonstrated in connection with FIG. 6 below, insertion of the drill pipe 500 in the female inductive couplers 306 and 308 substantially increases the inductance and reduces the reluctance of the unmated couplers 306 and 308, thereby enabling or facilitating electrical testing of the control and/or monitoring nodes 314 and 316.

Figure 6:
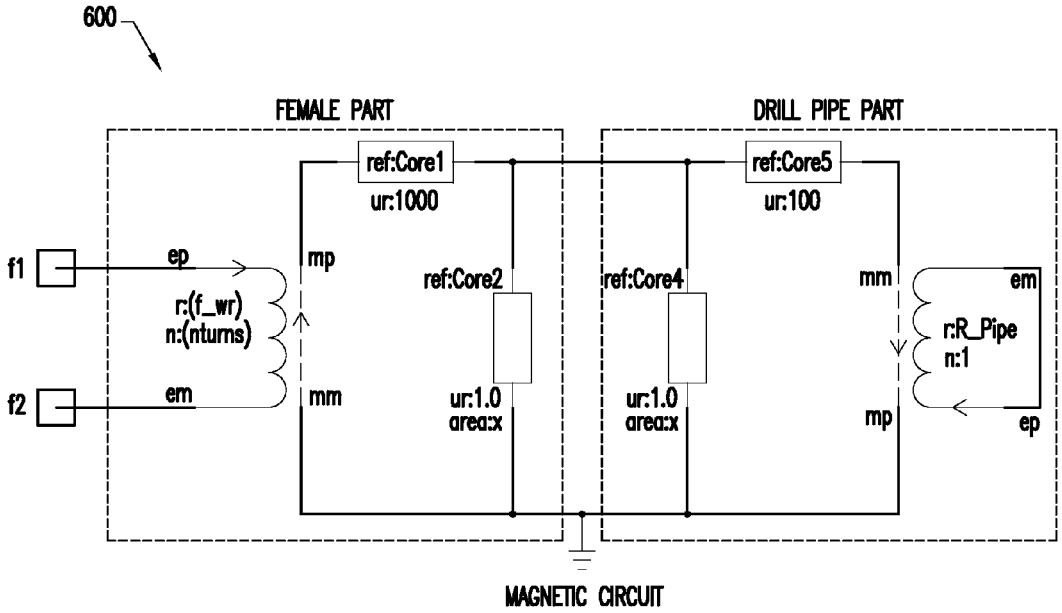
FIG. 6 is a schematic representation of an equivalent circuit for a female inductive coupler having a portion of drill pipe disposed therein as depicted in FIG. 5.

FIG. 6 is a schematic representation of an equivalent circuit 600 for a female inductive coupler having a portion of drill pipe disposed therein as depicted in FIG. 5. The reluctance and inductance values for the equivalent circuit 600 of FIG. 6 can be calculated using Equations 7 and 8 below.

$$R = R_{Core1} + R_{Core5}\alpha\left(\frac{1}{1000} + \frac{1}{100}\right) * \frac{l}{s} = \frac{\alpha}{100} \quad \text{Equation 7}$$

$$L_{female} = 100 * \beta \quad \text{Equation 8}$$

Thus, as can be seen from Equations 7 and 8 above, the presence of the drill pipe 500 significantly decreases the reluctance (and increases the inductance) relative to an unmated female inductive coupler. However, the drill pipe 500 presents a relatively small load (e.g., 100 microhenries) and incurs losses in the form of eddy currents that may be induced in the drill pipe 500. In some examples, an unmated female inductive coupler having a portion of drill pipe disposed therein may consume about 57 Watts (VA), which is a 40% reduction as compared to an unmated female inductive coupler.

Figure 7:
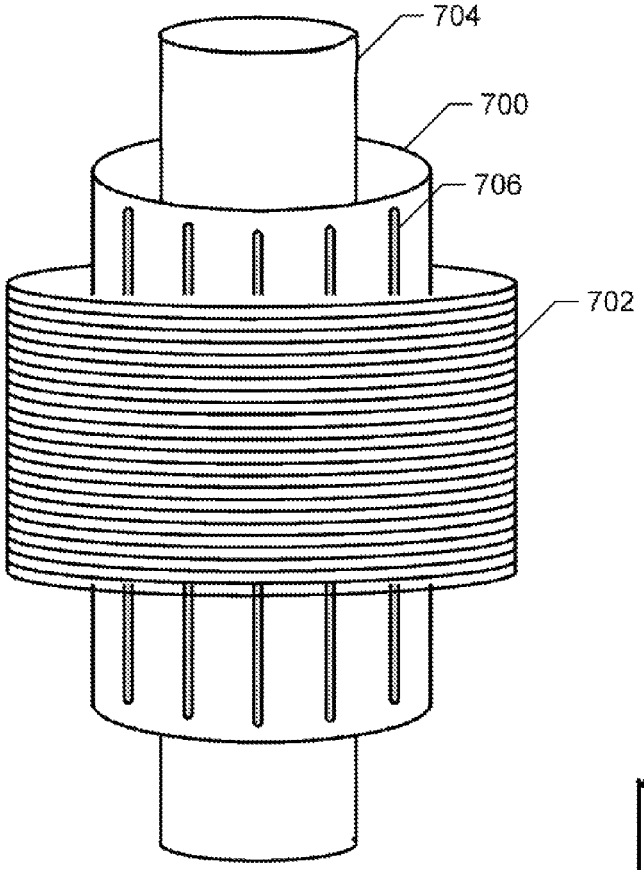
FIG. 7 illustrates an example slotted sleeve that may be disposed between a female inductive coupler and a drill pipe to facilitate electrical testing.

FIG. 7 illustrates an example slotted sleeve 700 that may be disposed between a female inductive coupler 702 and a drill pipe 704 to facilitate electrical testing of, for example, an RMC system and/or other downhole system(s). As depicted in FIG. 7, the sleeve 700 includes a plurality of openings or slots 706 extending along the length of the sleeve 700. These openings or slots 706 function to substantially reduce eddy currents induced in the sleeve 700 via the female inductive coupler 702 and, thus, further reduces the power consumption of the unmated female inductive coupler 702 as set forth in more detail in connection with FIG. 8 below.

Figure 8:
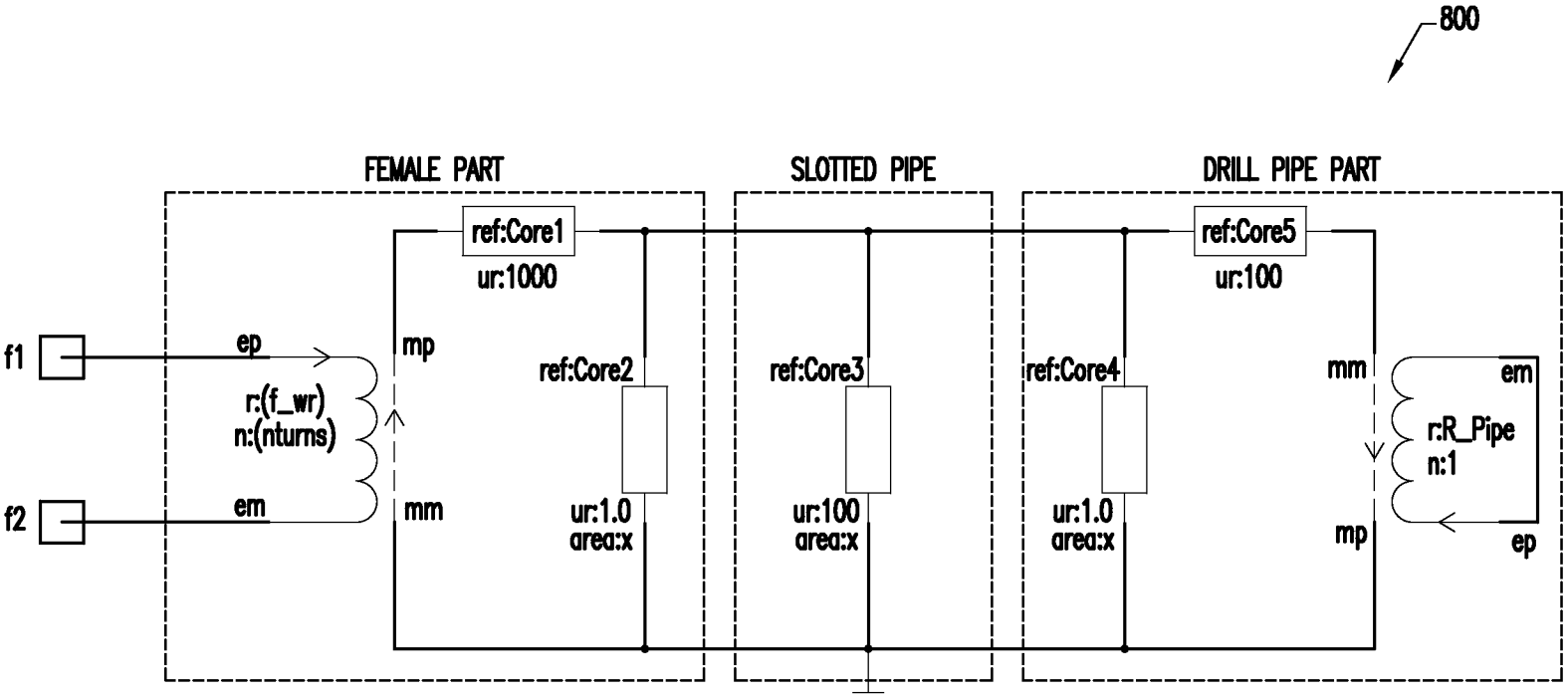
FIG. 8 is a schematic representation of an equivalent circuit of the slotted sleeve, drill pipe and inductive coupler arrangement shown in FIG. 7.

FIG. 8 is a schematic representation of an equivalent circuit 800 of the slotted sleeve 700, drill pipe 704 and inductive coupler 702 arrangement shown in FIG. 7. The reluctance and inductance provided by the arrangement shown in FIG. 7 and in accordance with the equivalent circuit shown in FIG. 8 are set forth below in Equations 9 and 10, respectively.

$$R = R_{Core1} + R_{Core5} // R_{Core3}\alpha\left(\frac{1}{1000} + \frac{1}{2.1}\right) * \frac{l}{s} \approx \frac{\alpha}{200} \quad \text{Equation 9}$$

$$L_{female} = 200 * \beta \quad \text{Equation 10}$$

As can be seen from Equations 9 and 10 above, the use of the slotted sleeve 700 further reduces reluctance and increases inductance relative to drill pipe alone as depicted in FIG. 5. The openings or slots 706 reduce resistive losses due to the presence of the sleeve 700. In some examples, the total power consumption of the arrangement shown in FIG. 8 may be about 27 Watts (VA).

Figure 9:
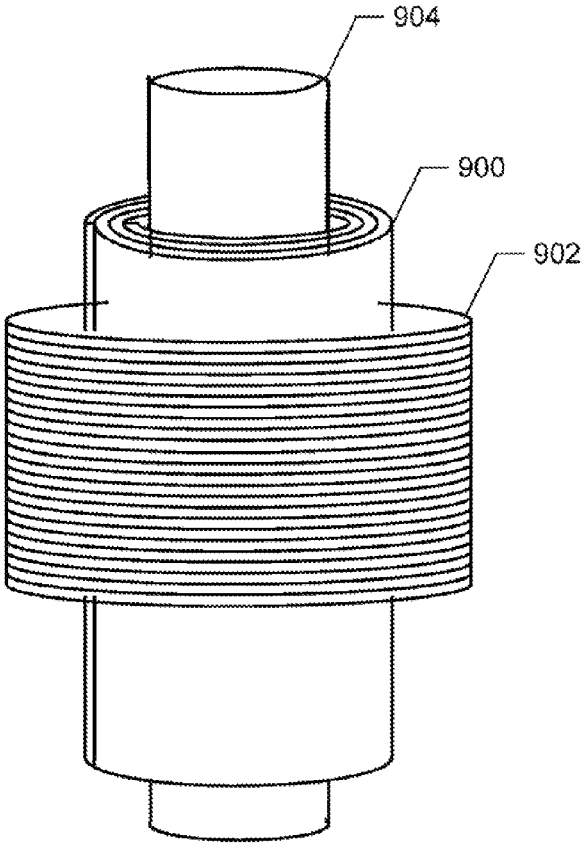
FIG. 9 illustrates an example multi-layer sleeve that may be used instead of the example slotted sleeve of FIG. 7.

FIG. 9 illustrates an example multi-layer sleeve 900 that may be used instead of the example slotted sleeve 700 of FIG. 7. The multi-layer sleeve 900 is disposed between an unmated female inductive coupler 902 and a portion of drill pipe 904. The multi-layer sleeve 900 may be formed using a layer of a metallic or metal material (e.g., a foil) that is spiral wrapped with a layer of electrically insulating material. Alternatively, the multi-layer sleeve 900 may be formed using alternating or concentric layers of the metal material and the insulating material. The arrangement shown in FIG. 9 may provide a further reduction in eddy currents and, thus, resistive losses relative to the arrangement shown in FIG. 7. In some examples, the total power consumption of the arrangement shown in FIG. 9 may be about 10 Watts (VA).

Figure 10:
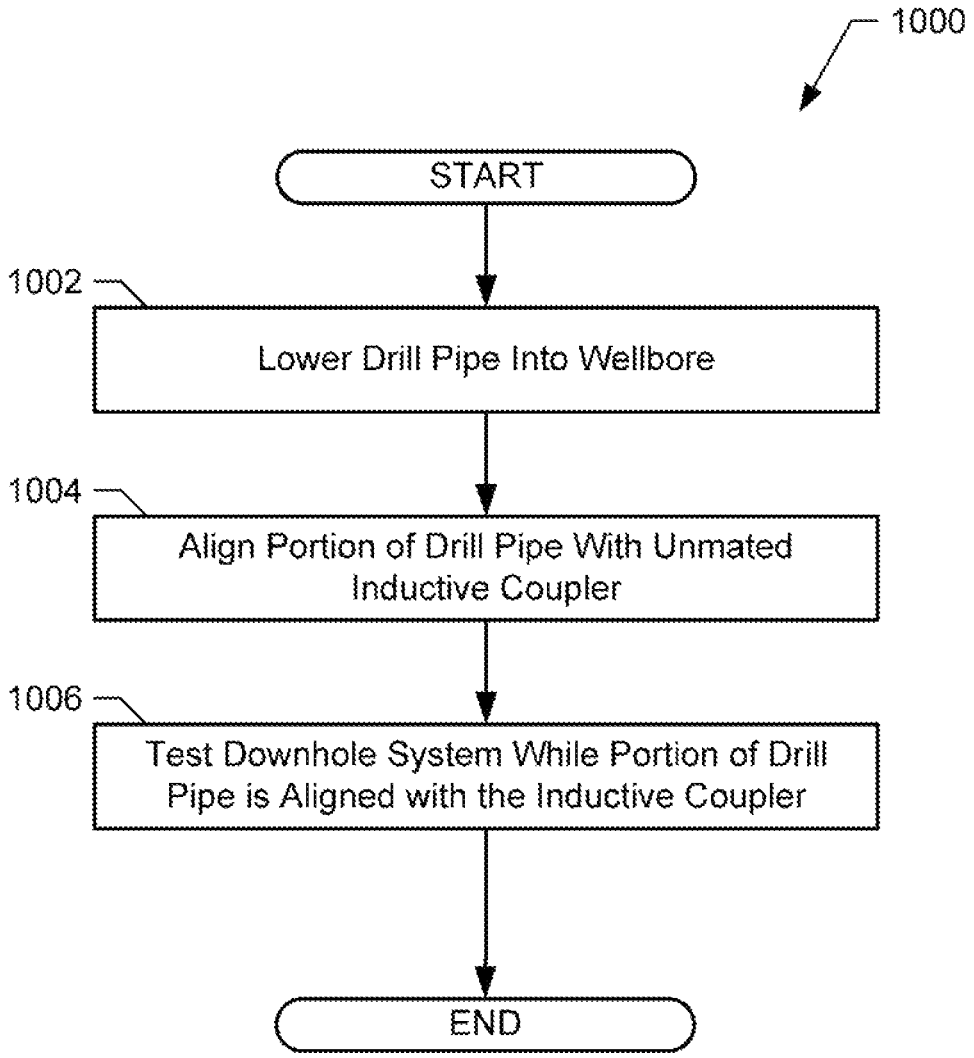
FIG. 10 is a flowchart depicting an example method that may be used to perform electrical testing in a downhole environment when one or more inductive couplers are not mated to corresponding couplers.

FIG. 10 is a flowchart depicting an example method 1000 that may be used to perform electrical testing in a downhole environment when one or more inductive couplers are not mated to corresponding couplers. The method 1000 involves lowering a drill pipe into a wellbore in which at least one female inductive coupler is unmated with its corresponding male inductive coupler (e.g., associated with an uncompleted lateral borehole) (block 1002). A portion of the drill pipe is then aligned with an unmated female inductive coupler, which may be fixed to a completion in the wellbore (block 1004). This alignment of the portion of the drill pipe with the unmated female inductive coupler reduces the reluctance and increases the inductance of a magnetic circuit including the inductive coupler, thereby substantially reducing the reactive power consumption of the unmated female inductive coupler. While the portion of the drill pipe remains aligned with the female inductive coupler, electrical testing of a downhole system (e.g., an RMC system) may be performed (block 1006).

The example method 1000 of FIG. 10 may be implemented using any of the example apparatus described herein including a sleeve (e.g., slotted or multi-layer) surrounding the portion of the drill pipe that is aligned with the unmated female inductive coupler. Further, more than one unmated female inductive coupler may be aligned with respective portions of drill pipe to reduce the reactive power consumed by each of the unmated female inductive couplers.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An inductive coupler assembly for use in a wellbore, comprising:

an inductive coupler fixed to a completion in the wellbore;

a drill pipe, a portion of which is to be located adjacent to the inductive coupler, the drill pipe having an outer diameter; and a sleeve comprising a magnetic material and having a tubular shape, the sleeve disposed within an inner diameter of the inductive coupler and surrounding the portion of the drill pipe to reduce a reluctance of a magnetic circuit including the inductive coupler, the sleeve having an inner diameter that is greater than the outer diameter of the drill pipe to define a gap therebetween.

2. The inductive coupler assembly of claim 1, wherein the inductive coupler is a female coupler.

3. The inductive coupler assembly of claim 1, wherein the sleeve includes a plurality of slots or openings extending through a thickness of the sleeve and along the length of the sleeve.

4. The inductive coupler assembly of claim 1, wherein the magnetic material has a permeability greater than one.

5. The inductive coupler assembly of claim 1, wherein the sleeve comprises a multi-layer structure that comprises a layer of a metallic material and a layer of electrically insulating material that is spirally wrapped.

6. The inductive coupler assembly of claim 1, wherein the sleeve comprises a multi-layer structure that comprises alternating concentric layers of metal material and insulating material.

7. The inductive coupler assembly of claim 1, wherein the sleeve comprises an alternating construction of a metal layer and an electrically insulating layer.

8. The inductive coupler assembly of claim 1, wherein a second gap is defined between the sleeve and an inner diameter of the inductor.

9. The inductive coupler assembly of claim 1, wherein the inductive coupler includes a coil, and wherein the sleeve is disposed within a diameter of the coil.

10. The inductive coupler assembly of claim 1, wherein the sleeve at least partially defines an inner diameter of the inductive coupler.

11. An apparatus, comprising:

a drill pipe having an outer diameter; and a sleeve comprising a magnetic material and having a tubular shape, the sleeve surrounding at least a portion of the drill pipe, the sleeve including a plurality of openings or layers extending through a thickness of the sleeve, the sleeve positioned on the drill pipe to reduce a reluctance of a magnetic circuit when the portion of the drill pipe is positioned adjacent an inductive coupler in a wellbore, the sleeve disposed within a coil of the magnetic circuit and an inner diameter of the inductive coupler, the sleeve having an inner diameter that is greater than the outer diameter of the drill pipe to define a gap therebetween.

12. The apparatus of claim 11, wherein the magnetic material has a permeability greater than one.

13. The apparatus of claim 11, wherein the openings comprise slots.

14. The apparatus of claim 11, wherein the layers comprise at least one layer of a magnetic material and at least one layer of an electrically insulating material.

15. The apparatus of claim 11, wherein the inductive coupler is fixed to a completion.

16. The apparatus of claim 11, wherein the inductive coupler is a female coupler.

17. The apparatus of claim 11, wherein the plurality of openings reduce eddy currents that may be induced in the drill pipe.

18. The apparatus of claim 11, wherein the sleeve comprises an alternating construction of a metal layer and an electrically insulating layer and wherein the electrically insulating layer comprises the plurality of openings.

* * * * *